US005518041A

United States Patent [19]

Sora et al.

[11] Patent Number: 5,518,041

[45] Date of Patent: May 21, 1996

[54] AIRGUIDE CHANNEL GEOMETRY FOR AIR JET LOOM

[75] Inventors: Gianluigi Sora, Vicenza; Lucio Sardella, Schio; Roberto Capitanio, Vincenza, all of Italy

[73] Assignee: Nuovo Pignone S.p.A., Florence, Italy

[21] Appl. No.: 326,388

[22] Filed: Oct. 20, 1994

[30] Foreign Application Priority Data

Oct. 27, 1993 [IT] Italy ..... MI93A2273

[51] Int. Cl.[6] ..... D03D 47/30; D03D 49/62

[52] U.S. Cl. ..... 139/192

[58] Field of Search ..... 139/191, 192

[56] References Cited

U.S. PATENT DOCUMENTS

| | | | |
|---|---|---|---|
| 4,481,980 | 11/1984 | Stenhouse | 139/192 |
| 4,989,646 | 2/1991 | Nitta | 139/192 |
| 5,323,814 | 6/1994 | Shiraki et al. | 139/192 |

FOREIGN PATENT DOCUMENTS

| | | | |
|---|---|---|---|
| 0336408 | 10/1989 | European Pat. Off. . | |
| 0533948 | 3/1993 | European Pat. Off. . | |
| 2184356 | 12/1973 | France . | |
| 8532045 | 3/1986 | Germany . | |
| 3740666 | 3/1989 | Germany . | |
| 4-24247 | 1/1992 | Japan | 139/192 |

*Primary Examiner*—Andy Falik

*Attorney, Agent, or Firm*—Oblon, Spivak, McClelland, Maier & Neustadt

[57] ABSTRACT

A reed for an air-jet loom which includes an entry flare allowing several main nozzles to be used. The reed has an inclination of the lower surface of an air guide channel, and an advantageous spacing between the binding spirals which support upper and lower ends of the reeds. The arrangement provides for effective, reliable multi-weft weaving, and can increase the weaving efficiency of the loom, particularly when weaving yarns with irregularities. In a preferred embodiment, the distance between the two binding spirals is approximately 81 mm, with the lower surface of the entry flare having an inclination of approximately 6° with respect to a normal to the rear surface of the channel.

1 Claim, 2 Drawing Sheets

AIRGUIDE CHANNEL GEOMETRY FOR AIR JET LOOM

BACKGROUND OF THE INVENTION

1. Field of the Invention

This invention relates to a reed for an air-jet loom which includes an entry flare hence allowing several main nozzles to be used, and utilizes a specific inclination of the lower surface of the air and weft guide channel and a specific distance between the binding spirals for the profiled dents of the reed. This arrangement results in effective, reliable multi-weft weaving with a consequent considerable increase in the weaving efficiency of the loom, particularly when weaving with yarns comprising considerable irregularities.

2. Discussion of the Background

Profiled dent reeds for air-jet looms are already known from the state of the art.

The known reeds consist substantially of a series of dents positioned side by side spaced apart by binding spirals, and profiled such as to form an open guide channel for the air and weft.

Besides making it difficult to use several main nozzles because of the small width of the guide channel, such known reeds are generally formed with different-dimension profiling for different uses.

SUMMARY OF THE INVENTION

In accordance with an aspect of the present invention, it has now been experimentally found that with a 6° inclination of the lower surface of the air and weft guide channel to the normal to the rear surface of the channel and with a distance of 81 mm between the binding spirals for the profiled dents, a profiled reed is obtained representing the best compromise between dent flexibility, which is sufficient to allow irregularities in the warp yarn to pass between said dents, and reed dimensions such as to limit reed inertia.

In this respect, from said experimental tests a general improvement in loom weaving efficiency has been noted, with a considerable reduction in stoppages due to warp breakage.

According to a further characteristic of the present invention, said air and weft guide channel is provided with an entry flare which by increasing the width of the entry channel enables a greater number of main nozzles to be used without difficulty, hence allowing weaving with various wefts differing in terms of quality or color.

Hence, the air-jet loom reed, comprising substantially a series of side by side dents spaced apart by binding spirals positioned at the ends of the dents, which are profiled in such a manner as to form an open guide channel for the air and weft, is characterized according to the present invention in that the distance between the two binding spirals is about 81 mm, the open channel having an entry flare, and an open inclination of its lower surface to the normal to the channel rear surface of about 6°.

BRIEF DESCRIPTION OF THE DRAWINGS

The invention is described in detail hereinafter with reference to the accompanying drawings which illustrate a preferred embodiment thereof given by way of non-limiting example in that technical or constructional modifications can be made thereto without leaving the scope of the present invention.

In said drawings.

DESCRIPTION OF THE PREFERRED EMBODIMENT

Figure 1:
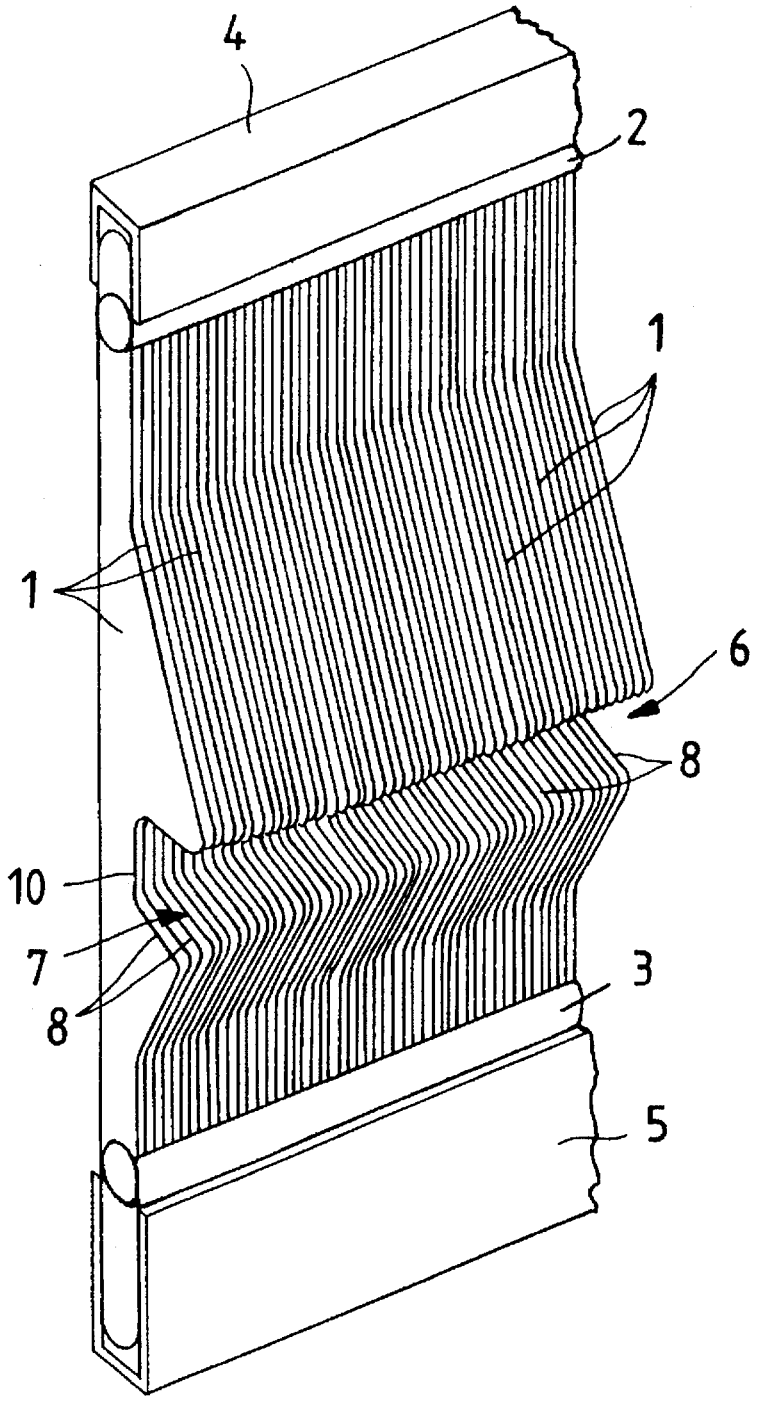
FIG. 1 is a partial perspective view of a reed for an air-jet loom formed in accordance with the invention.
Figure 2:
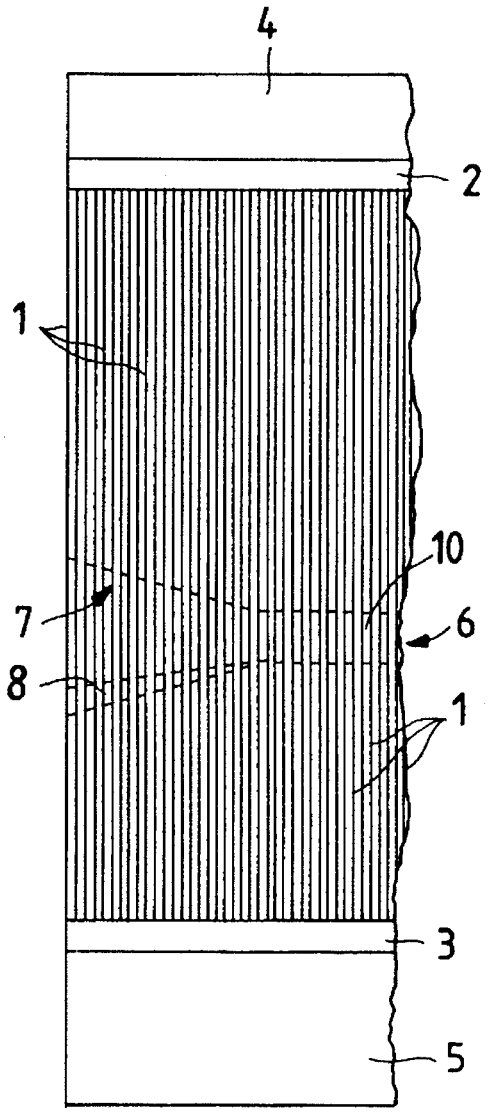
FIG. 2 is a longitudinal view of the reed of FIG. 1.
Figure 3:
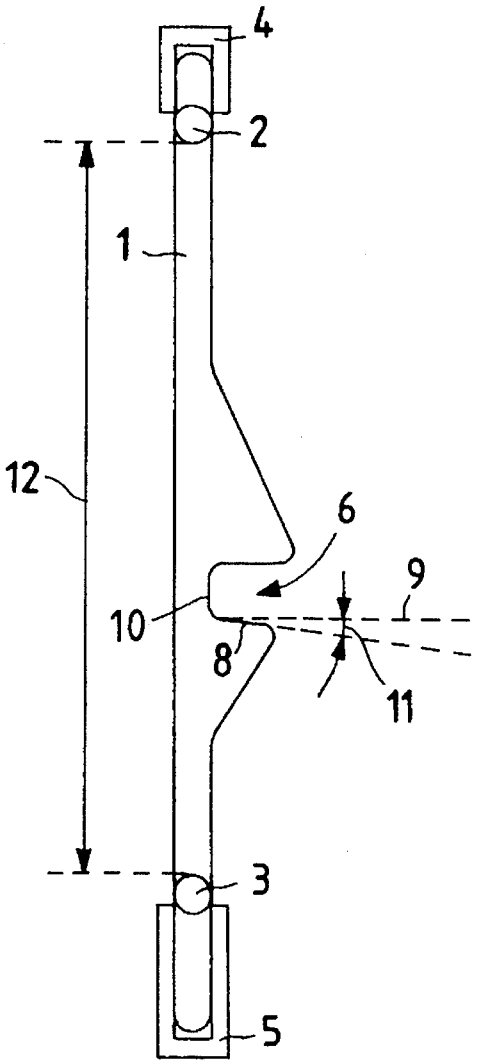
FIG. 3 is a front view of the reed of FIG. 1.

In the figures the reference numeral 1 indicates the profiled dents of the reed, which are positioned side by side spaced apart by the binding spirals 2 and 3 and held together by the end section bars 4 and 5. Said dents 1 are profiled in such a manner as to form for the air and weft an open guide channel 6 having an entry flare 7 and a downward inclination, i.e., in the sense of opening or increasing the width of the channel, of its lower surface 8 to the normal 9 to the rear surface 10 of said channel of about 6°, represented by the angle 11 (see specifically FIG. 3). As shown in FIG. 2, this downward inclination is provided in the entry flare 7. Finally, the distance 12 between said two binding spirals 2 and 3 is about 81 mm.

Obviously, modifications and variations of the present invention are possible in light of the above teachings.

We claim:

1. A reed for an air-jet loom, comprising substantially a series of side by side dents including upper and lower ends, said upper and lower ends being supported by two spaced apart binding spirals positioned at said upper and lower ends, said dents having a profile which includes an open guide channel for an air injected weft, wherein a distance between said two binding spirals is about 81 mm, said open channel having an entry flare which is at least partially defined by an inclined lower surface and a rear surface, wherein the amount of inclination of the lower surface with respect to a normal from the rear surface in said entry flare is about 6°.

* * * * *